US008944562B2

(12) United States Patent
Nakagawa et al.

(10) Patent No.: US 8,944,562 B2
(45) Date of Patent: Feb. 3, 2015

(54) PRINTING APPARATUS AND CONTROL METHOD THEREFOR

(71) Applicant: Canon Kabushiki Kaisha, Tokyo (JP)

(72) Inventors: Yoshinori Nakagawa, Kawasaki (JP); Yuji Konno, Kawasaki (JP); Tomoki Yamamuro, Kawasaki (JP); Hideki Takayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/864,614

(22) Filed: Apr. 17, 2013

(65) Prior Publication Data

US 2013/0293631 A1 Nov. 7, 2013

(30) Foreign Application Priority Data

May 7, 2012 (JP) ..... 2012-106318
Apr. 8, 2013 (JP) ..... 2013-080840

(51) Int. Cl.
*B41J 2/165* (2006.01)

(52) U.S. Cl.
CPC ..... *B41J 2/16532* (2013.01); *B41J 2/16523* (2013.01); *B41J 2002/16573* (2013.01)
USPC ..... 347/30; 347/84; 347/85; 347/86

(58) Field of Classification Search
CPC ..... B41J 2/1707
USPC ..... 347/30, 84–86, 93
See application file for complete search history.

(56) References Cited

U.S. PATENT DOCUMENTS

| | | | | |
|---|---|---|---|---|
| 4,577,203 | A * | 3/1986 | Kawamura | 347/30 |
| 5,488,401 | A * | 1/1996 | Mochizuki et al. | 347/86 |
| 5,997,121 | A * | 12/1999 | Altfather et al. | 347/7 |
| 6,530,642 | B1 | 3/2003 | Uchikata et al. | |
| 6,648,447 | B2 | 11/2003 | Sugimoto et al. | |
| 6,984,009 | B2 | 1/2006 | Nakagawa et al. | |
| 7,011,386 | B2 | 3/2006 | Iwasaki et al. | |
| 7,014,292 | B2 | 3/2006 | Yazawa et al. | |
| 7,029,092 | B2 | 4/2006 | Edamura et al. | |
| 7,270,409 | B2 | 9/2007 | Iwasaki et al. | |
| 7,395,778 | B2 | 7/2008 | Iwasaki et al. | |
| 7,396,095 | B2 | 7/2008 | Nakagawa et al. | |
| 7,506,953 | B2 | 3/2009 | Edamura et al. | |
| 7,556,339 | B2 | 7/2009 | Nakagawa et al. | |
| 7,588,639 | B2 | 9/2009 | Iwasaki et al. | |

(Continued)

FOREIGN PATENT DOCUMENTS

| | | | |
|---|---|---|---|
| JP | 02-198861 | A | 8/1990 |
| JP | 2002-137419 | A | 5/2002 |
| JP | 2004-090233 | A | 3/2004 |

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

The invention has been made to prevent ink adhesion or an ink discharge failure caused by ink adhesion due to evaporation of volatile components of ink which occurs when the ink receptor of a printhead is exposed to air for a long time. If an inkjet printhead and an ink tank containing ink to be supplied to the printhead are attached to a carriage, the ink supply port of the ink tank is pressed to the ink receptor of the printhead. In this arrangement, the presence/absence of attachment of the ink tank to the carriage is detected. If it is detected that the ink tank is not attached to the carriage, a suction operation for the printhead is performed and controlled to suck out ink from the nozzles of the printhead.

20 Claims, 9 Drawing Sheets

(56) References Cited

U.S. PATENT DOCUMENTS

| | | | | |
|---|---|---|---|---|
| 7,703,879 | B2 | 4/2010 | Yazawa et al. | |
| 8,087,744 | B2 | 1/2012 | Nakagawa et al. | |
| 2003/0052951 | A1* | 3/2003 | Ujita et al. | 347/86 |
| 2011/0227980 | A1 | 9/2011 | Saitoh et al. | |

* cited by examiner

PRINTING APPARATUS AND CONTROL METHOD THEREFOR

BACKGROUND OF THE INVENTION

1. Field of the Invention

The present invention relates to a printing apparatus and a control method therefor and, particularly, to a printing apparatus including an inkjet printhead and an inkjet printhead control method used in the apparatus.

2. Description of the Related Art

Among printing apparatuses which are used as printing means for images, characters, and the like in a printer, copying machine, or facsimile apparatus, inkjet printing apparatuses (to be simply referred to as printing apparatuses hereinafter) perform printing by discharging ink from an inkjet printhead (to be simply referred to as a printhead hereinafter) onto a printing medium.

The printing apparatuses are roughly classified into a serial type printing apparatus which performs printing while scanning the printhead in a direction intersecting the conveyance direction of the printing medium, and a line type printing apparatus which performs printing while holding, at a fixed position, a full-line printhead having a print length corresponding to the full width of the printing medium.

The above-described serial type printing apparatus generally sets a printing medium at a predetermined position, and repeats reciprocal movement of a carriage, in a predetermined direction on the printing medium, to which the printhead is mounted and paper conveyance by a predetermined amount, thereby printing images on the entire surface of the printing medium.

A printing apparatus which supports color printing and has an arrangement including a plurality of printheads each corresponding to one ink color has become widespread. To realize recent high photo quality printing, the size of droplets discharged from the printhead has become small. To discharge such small droplets, the diameter of each nozzle of the printhead has also become small. A general printhead has nozzles with a diameter of about 10 to 50 μm.

Some printing apparatuses adopt an arrangement in which an ink tank and printhead are separable/exchangeable. For this type of printing apparatus, an ink channel between an ink tank and a printhead is temporarily exposed in exchanging the ink tank, and thus a foreign substance such as dust may enter the ink channel. If a foreign substance enters the ink channel, and reaches a nozzle, clogging of the nozzle may occur depending on the size of the dust, thereby causing an ink discharge failure.

To solve this problem, for example, as disclosed in Japanese Patent Laid-Open No. 2-198861, a filter for preventing a foreign substance from entering a portion where ink is supplied has been conventionally provided.

In the above conventional example, however, if an ink tank is detached from a printhead, the filter including ink is undesirably exposed to the outer air. If the filter is left in that state for a long time, the viscosity of ink increases due to evaporation of volatile components, and clogging of the filter may occur. If clogging of the filter occurs, ink may not be smoothly supplied to the printhead, thereby causing an ink discharge failure.

SUMMARY OF THE INVENTION

Accordingly, the present invention is conceived as a response to the above-described disadvantages of the conventional art.

For example, a printing apparatus and a control method used in the apparatus according to this invention are capable of preventing an ink discharge failure to maintain high-quality printing even if the ink receptor of a printhead is exposed to air for a long time in exchanging an ink tank.

According to one aspect of the present invention, there is provided a printing apparatus including a printhead having at least one nozzle array formed by a plurality of nozzles for discharging ink, and a carriage to which the printhead and at least one ink tank for supplying ink to the printhead are mounted, wherein a filter member is arranged between the ink tank and the printhead. The apparatus comprises: a detection unit configured to detect presence/absence of attachment of the ink tank to the carriage; a suction unit configured to suck out ink from the plurality of nozzles of the printhead; and a control unit configured to control the suction unit to perform a suction operation if the detection unit detects that the ink tank is not mounted to the carriage and not to perform the suction operation if the detection unit detects that the ink tank is mounted to the carriage.

According to another aspect of the present invention, there is provided a control method for a printing apparatus including a printhead having a nozzle surface with at least one nozzle array formed by a plurality of nozzles for discharging ink, and a carriage to which the printhead and at least one ink tank for supplying ink to the printhead are mounted, wherein a filter member is arranged between the ink tank and the printhead. The method comprises: detecting whether or not the ink tank is mounted to the carriage; and performing, if it is detected that the ink tank is not mounted to the carriage, a suction operation of sucking out ink from the plurality of nozzles of the printhead, and not performing the suction operation, if it is detected that the ink tank is mounted to the carriage.

The invention is particularly advantageous since it is possible to prevent ink adhesion and an ink discharge failure to maintain high-quality printing even if a filter member is exposed to the air for a long time in exchanging an ink tank.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similarly to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

<General Outline of Printing Apparatus (FIG. 1)>

Figure 1:
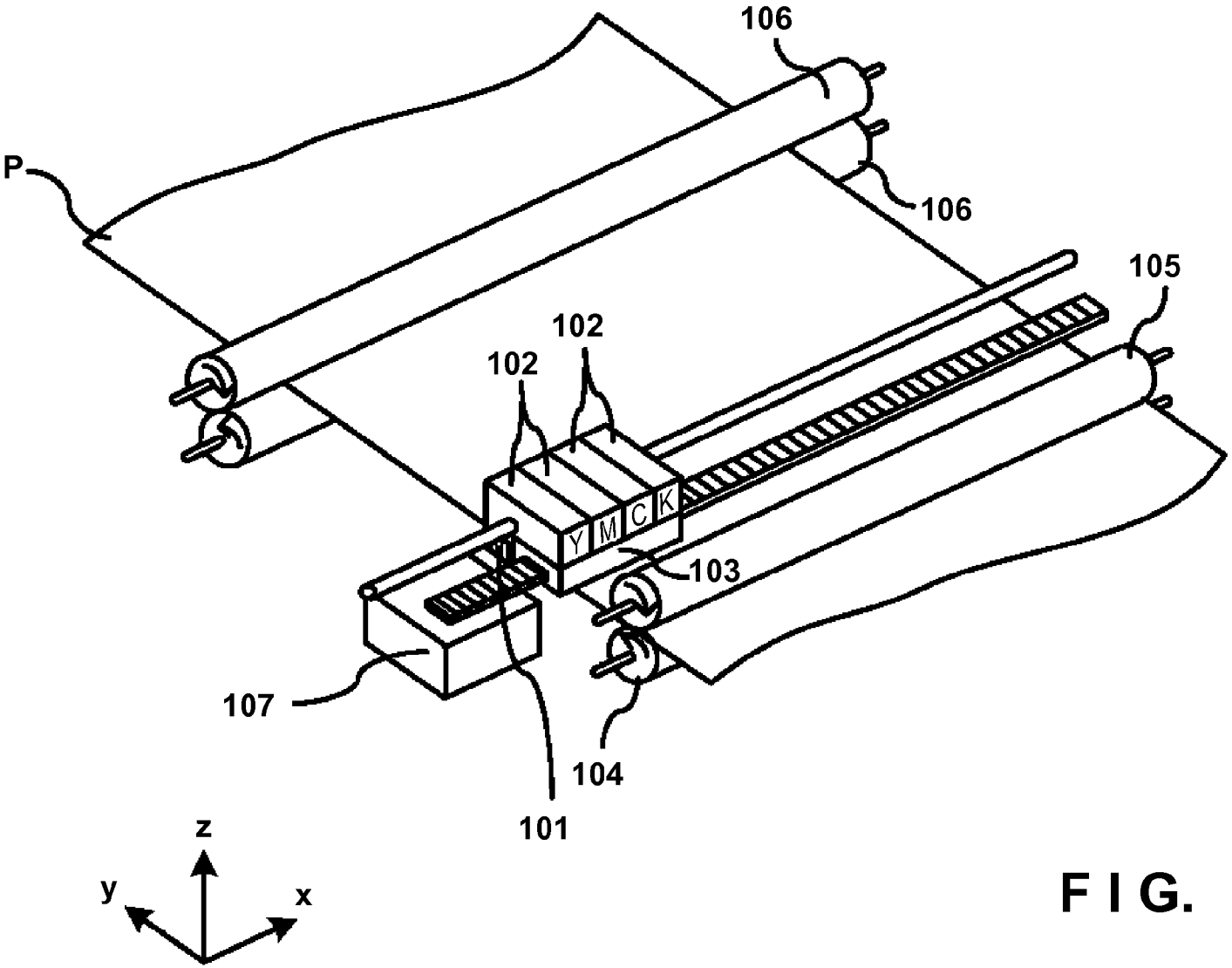
FIG. 1 is a perspective view showing the outer appearance of a printing apparatus for performing printing using an inkjet printhead as an exemplary embodiment of the present invention.

FIG. 1 is a perspective view showing the outer appearance of a printing apparatus for performing printing using an inkjet printhead (to be simply referred to as a printhead hereinafter) as an exemplary embodiment of the present invention.

As shown in FIG. 1, a printhead 101 is attached to a carriage 103, and supplied with inks from individual ink tanks 102 of four colors: black (K), cyan (C), magenta (M), and yellow (Y). Each ink tank 102 is individually exchangeable, and holds ink by a negative pressure generation mechanism within itself. To exchange the ink tanks 102, the user opens a cover (not shown) provided in the opening of the printing apparatus which enables to access the ink tanks.

The carriage 103 reciprocates in a main scanning direction (x direction in FIG. 1) by a carriage motor (not shown). Referring to FIG. 1, reference symbol P denotes a printing medium. Printing for a width corresponding to one scanning operation is completed by scanning of the carriage 103 in the main scanning direction and discharge of ink droplets by the printhead 101. Upon completion of printing for a width corresponding to one scanning operation, the printing medium P clamped between a conveyance roller 104 and a pinch roller 105 is conveyed in the y direction (sub-scanning direction) in FIG. 1 by rotation of the conveyance roller 104 caused by a conveyance motor (not shown).

Furthermore, the printing medium P is clamped by a pair of paper discharge rollers 106 on the downstream side in the conveyance direction (the y direction in FIG. 1), and a tension is generated between the clamping portion by the pair of paper discharge rollers 106 and that by the conveyance roller 104 and pinch roller 105. The printing apparatus completes printing for one page by scanning of the carriage 103 in the main scanning direction, ink droplet discharge from the printhead 101, and conveyance of the printing medium by the conveyance roller 104.

Note that a maintenance unit (recovery unit) 107 is arranged outside a print area within the moving range of the carriage 103. The maintenance unit 107 includes a wiping mechanism and a suction mechanism.

<Detailed Arrangement Around Carriage (FIGS. 2A and 2B)>

Figure 2B:
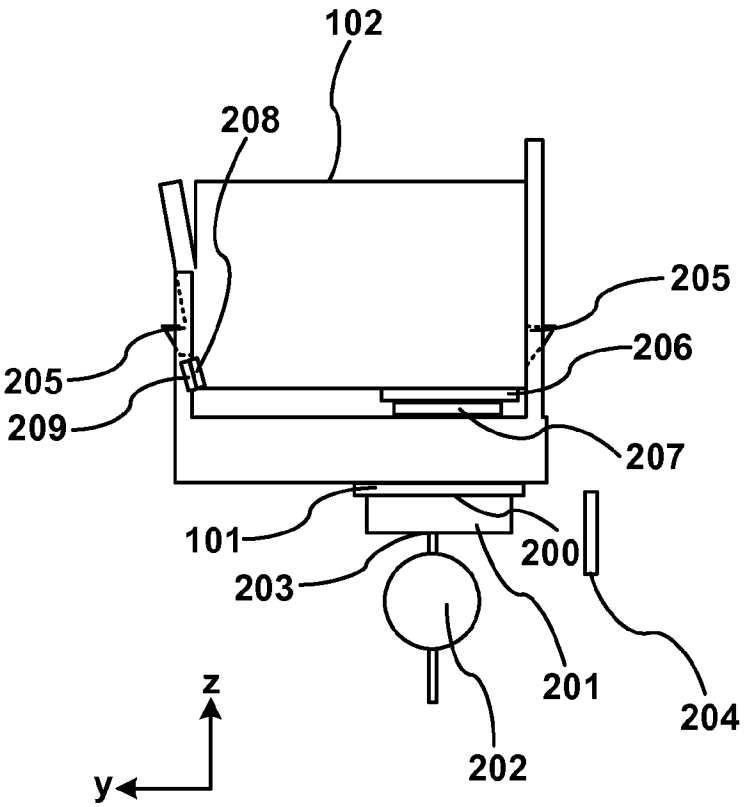
FIG. 2A is a partial front view and FIG. 2B is a side sectional view of a printing apparatus 2 shown in FIG. 1, which show an arrangement around the carriage of the printing apparatus 2.
Figure 2A:
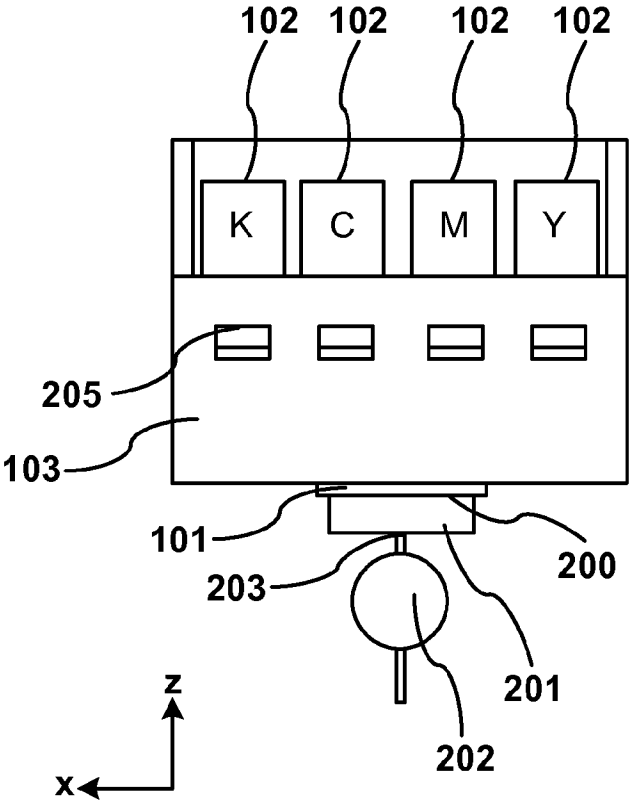

FIGS. 2A and 2B are a partial front view and a side sectional view of a printing apparatus 2 shown in FIG. 1, which show an arrangement around the carriage of the printing apparatus 2.

FIG. 2A is a front view schematically showing the arrangement of the printhead 101 and recovery unit 107 when viewed from the y direction in FIG. 1. FIG. 2B is a side sectional view schematically showing the arrangement of the printhead 101 and recovery unit 107 when viewed from the x direction in FIG. 1.

In a state shown in FIGS. 2A and 2B, a cap 201 caps a nozzle surface (ink discharge surface) 200 of the printhead 101, which includes nozzle arrays corresponding to the respective ink colors of K, C, M, and Y. The cap 201 is movable in the upper-and-lower direction (z direction) by a driving mechanism (not shown), and is used to perform a capping operation and a cap opening operation for the ink discharge surface 200.

A suction port 203 connecting to a suction pump 202 is provided on the bottom surface of the cap 201. To perform a suction operation for the printhead by the recovery unit 107, the cap 201 caps the nozzle surface, the suction pump 202 is operated, and negative pressure is generated within the cap 201, thereby sucking out ink from the nozzles.

As shown in FIG. 2B, a wiper 204 for wiping dust on the nozzle surface of the printhead 101 is arranged as a wiping mechanism in the recovery unit 107, and wipes ink adhering to the nozzle surface. The wiper 204 wipes ink on the nozzle surface by moving in the y direction in FIG. 2B by a driving motor (not shown).

The ink tank 102 is engaged with the carriage 103 by two pawl portions 205 provided in the carriage 103, and biased in a direction opposite to an arrow z. This causes an ink supply port 206 made by sponge of the ink tank 102 to be pressed to an ink receptor 207 of the printhead 101.

An IC chip 208 in which information such as an ink tank use history is written is arranged in each ink tank 102. When the IC chip 208 electrically contacts a contact portion 209 provided in the carriage 103, the printing apparatus can read out information from the IC chip 208. It is possible to detect that the ink tank is attached by reading out the information of the IC chip 208 via the contact portion 209, thereby functioning as an ink tank detection sensor.

<Control Arrangement (FIG. 3)>

A control arrangement for controlling print processing by the printing apparatus described with reference to FIG. 1 will now be explained.

Figure 3:
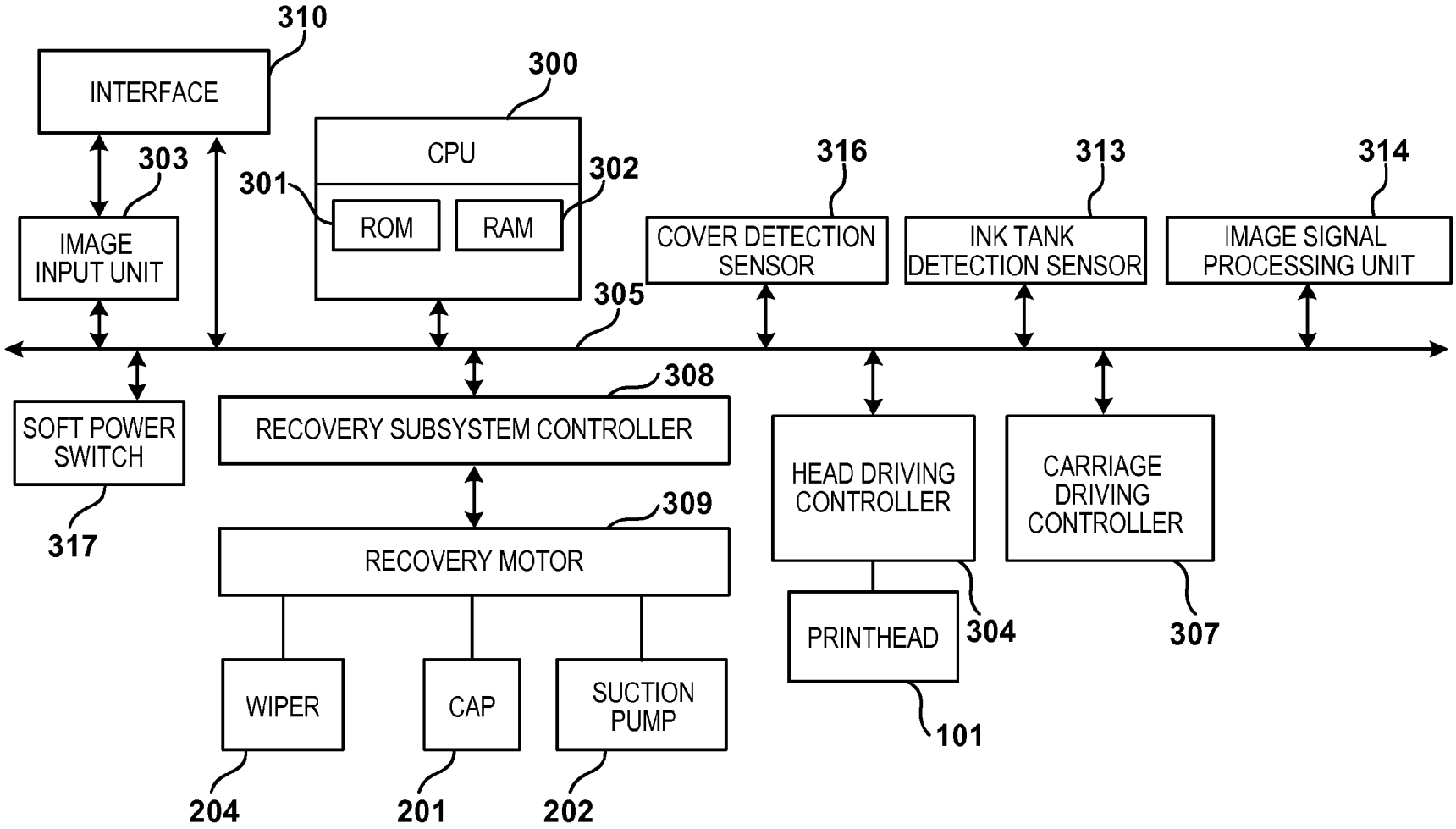
FIG. 3 is a block diagram showing the control arrangement of the printing apparatus shown in FIG. 1.

FIG. 3 is a block diagram showing the control arrangement of the printing apparatus shown in FIG. 1.

Referring to FIG. 3, a CPU 300 controls each component of the apparatus via a main bus line 305, and executes data processing. That is, the CPU 300 executes programs stored in a ROM 301 to execute data processing, control driving of the printhead, and control driving of the carriage via the following respective components, thereby printing an image. The CPU 300 can execute communication processing with a host apparatus via an interface 310.

A RAM 302 is used as a work area for data processing or the like by the CPU 300, and temporarily stores print data for a plurality of scanning and printing operations of the printhead, parameters associated with a suction processing operation and an ink supply operation by the printing apparatus, and the like. An image input unit 303 temporarily holds image data received and input from the host apparatus via the interface 310.

A recovery subsystem controller 308 controls driving of a recovery motor 309 according to a recovery processing program stored in the ROM 301, and controls a suction operation such as an up/down operation of the cap 201, the operation of the wiper 204, and the operation of the suction pump 202. A head driving controller 304 controls driving of the printhead 101, and generally causes the printhead 101 to perform a preliminary discharge operation and an ink discharge operation for printing. A carriage driving controller 307 controls scanning of the printhead 101 for a print operation based on print data processed by an image signal processing unit 314 as well as movement to the recovery unit for a suction operation.

An ink tank detection sensor 313 can detect whether an ink tank is attached. In this embodiment, the sensor 313 detects the presence/absence of attachment by electrically detecting the IC chip attached to the ink tank. Note that the ink tank detection sensor is not limited to a sensor for electrically detecting an ink tank, and a mechanical switch or optical sensor may be used.

A cover detection sensor 316 detects an open/closed state of the cover of the printing apparatus. Similarly to the ink tank detection sensor, any sensor such as an electrical contact, mechanical switch, or optical sensor may be used as the cover detection sensor 316.

A soft power switch 317 is used to control ON/OFF of a power supply which supplies power to the controllers of the printing apparatus. If the soft power switch 317 is turned off by a user operation, power supply to controllers other than that associated with control of the soft power switch is turned off.

Figure 4:
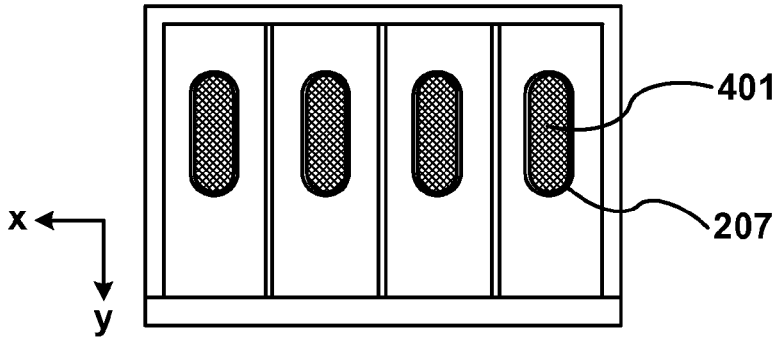
FIG. 4 is a plan view showing the carriage when ink tanks are detached.

FIG. 4 is a plan view showing the carriage when the ink tanks are detached.

FIG. 4 is a schematic view showing the carriage 103 with the ink tanks detached when viewed from the z direction shown in FIG. 1. As shown in FIG. 4, ink from an ink tank flows into the printhead via a filter 401 provided in the ink receptor 207. The filter 401 is a filter made of a sintered stainless steel fiber, and can collect impurities (foreign substances) with a size of 10 μm or larger.

As is apparent from FIG. 4, the filter 401 is arranged in the ink receptor 207 of an ink tank of each color. Ink from which impurities have been removed and into which entering of foreign substances has been prevented flows into the printhead.

Figure 5A:
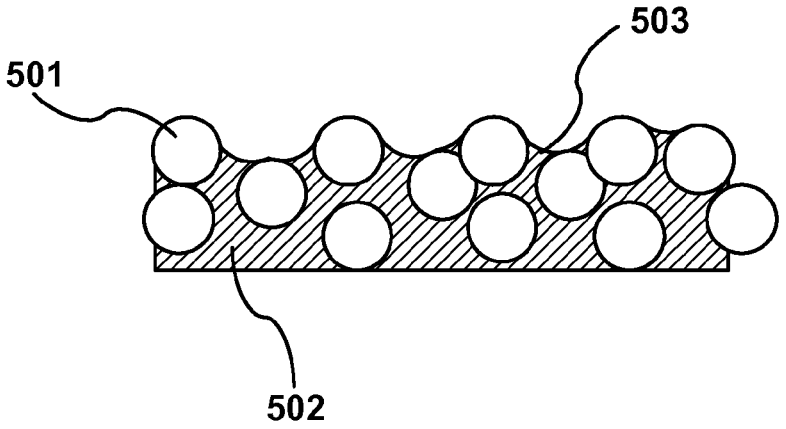
FIGS. 5A and 5B are sectional views each schematically showing the upper portion of a filter when an ink tank is detached.
Figure 5B:
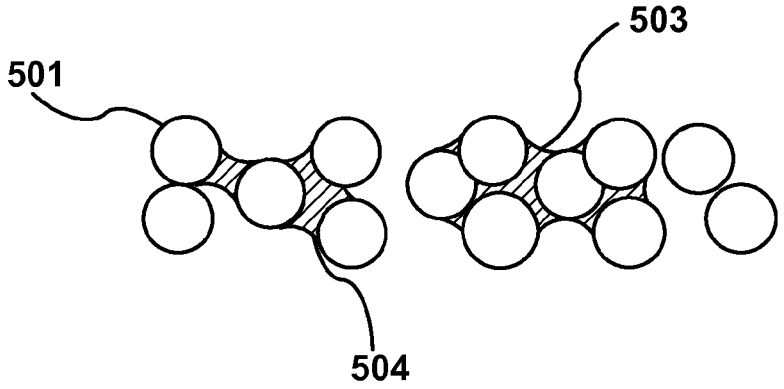

FIGS. 5A and 5B are side sectional views each schematically showing the structure of the filter when the ink tank is detached. FIG. 5A is a side sectional view showing the filter immediately after the ink tank is detached. FIG. 5B is a side sectional view showing the filter after a long time elapses since the ink tank is detached.

Referring to FIGS. 5A and 5B, reference numeral 501 denotes a sintered non-woven stainless steel fiber; 502, ink impregnated in the filter; and 503, a meniscus occurring on the boundary face between the outer air and the ink 502 when the tank is detached.

As shown in FIG. 5A, if the ink tank is detached, a meniscus occurs on the boundary face between air and the ink 502 impregnated in the filter 401. Furthermore, there is no longer negative pressure from the ink tank, a downward force acts on ink from the filter 401 to the printhead 101 by the weight of the ink itself, and thus the meniscus 503 becomes concave toward the printhead. The meniscus 503 occurring in the filter 401 enables holding ink from the filter 401 to the printhead 101 without leaking.

If, however, the ink tank remains detached for a long time, the volatile components continue to evaporate from the meniscus 503. As shown in FIG. 5B, if the ink tank remains detached for a long time, the ink volume decreases due to evaporation of volatile components, and thus the meniscus recedes. As a result, the meniscus recedes toward the printhead 101 (downward in FIG. 5B) rather than the filter 401 but the viscosity of ink 504 remaining in the stainless fiber gaps by the capillary force increases, thereby causing ink adhesion to the filter 401. This results in clogging of the filter 401. If clogging of the filter 401 occurs, an ink supply amount from the ink tank decreases disabling a normal ink discharge operation and thereby causing a discharge failure. Control of the printing apparatus is performed not to cause clogging of the filter 401. Since it is well known that clogging of the filter 401 easily occurs especially when pigment ink is used, it is particularly desirable to control the printing apparatus not to cause clogging, as will be described below.

Some embodiments of control processing performed not to cause clogging of the filter 401 will be described.

First Embodiment

Figure 6:
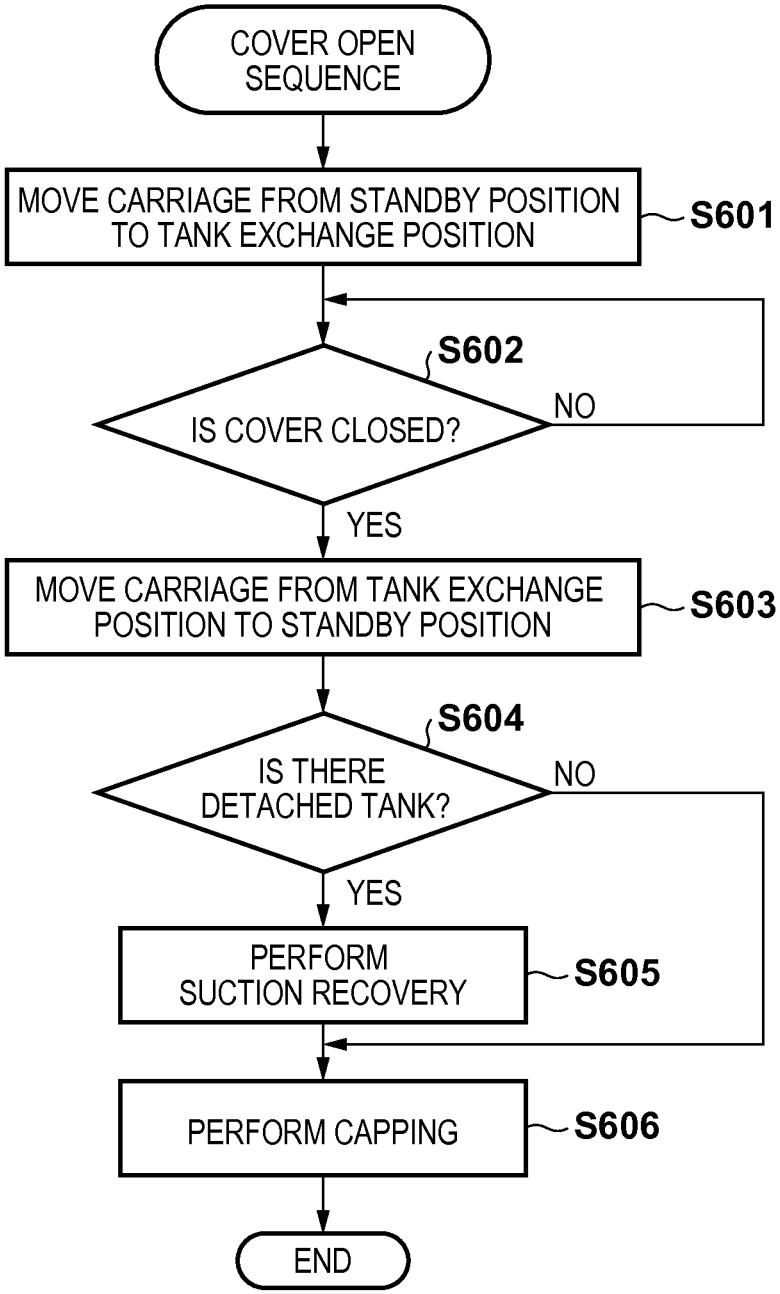
FIG. 6 is a flowchart illustrating suction processing according to the first embodiment.

FIG. 6 is a flowchart illustrating control processing according to the first embodiment.

According to FIG. 6, upon start of a cover open sequence in exchanging an ink tank, in step S601 a printing apparatus uses a cover detection sensor to detect that a cover has been opened. The carriage (CR) 103 is positioned at the standby position of a recovery unit 107 while no printing is performed. If it is detected that the cover has been opened, the carriage 103 moves to a tank exchange position where the user can access the ink tank. After that, the ink tank is exchangeable until the cover is closed.

In step S602, the printing apparatus uses the cover detection sensor to check whether the cover has been closed. If it is detected that the cover has been closed, the process advances to step S603. In step S603, the carriage 103 returns to the standby position. The CPU 300 controls movement of the carriage in steps S601 to S603 via the carriage driving controller 307.

In step S604, the printing apparatus uses an ink tank detection sensor to check whether all ink tanks have been attached. If it is determined that all the ink tanks have been attached, the process advances to step S606. On the other hand, if it is determined that at least one ink tank has not been attached, the process advances to step S605.

Since there is a detached ink tank, and a filter 401 impregnated with ink is exposed to the outer air, the printing apparatus operates the suction pump 202 to perform an ink suction operation for the nozzles of the printhead 101 in step S605. If ink is sucked out from the printhead 101, almost all the ink impregnated into the filter is sucked out, and thus the amount of ink remaining in the filter 401 is significantly small. If, therefore, the remaining ink evaporates and its viscosity increases, clogging of the filter which causes a discharge failure does not occur.

In step S606, the printhead 101 is capped to protect the printhead, thereby terminating the process.

According to the above-described embodiment, if there is a detached ink tank, a suction operation is performed for the printhead to suck ink impregnated in the filter. It is, therefore, possible to suppress clogging of the filter, thereby preventing deterioration in quality of a print image due to a discharge failure.

Note that if it is determined in step S604 of FIG. 6 that there is at least one ink tank which is not attached to the printing apparatus, an ink suction operation is executed for the nozzles of the printhead 101, thereby sucking out ink remaining in the filter 401. However, if all the plurality of ink tanks to be attached to the printing apparatus are not yet attached, it may be controlled to execute an ink suction operation for the nozzles of the printhead 101.

Second Embodiment

In the arrangement according to the first embodiment, one cap caps all the nozzle arrays for discharging K, C, M, and Y inks, respectively. If the ink tank of at least one color is detached, inks of other colors are undesirably sucked out, and ink may be wasted more than necessary. To eliminate such a disadvantage, in the second embodiment, a recovery unit 107 includes a plurality of caps, and a suction operation is executed for only a cap corresponding to a detached ink tank.

Figure 7:
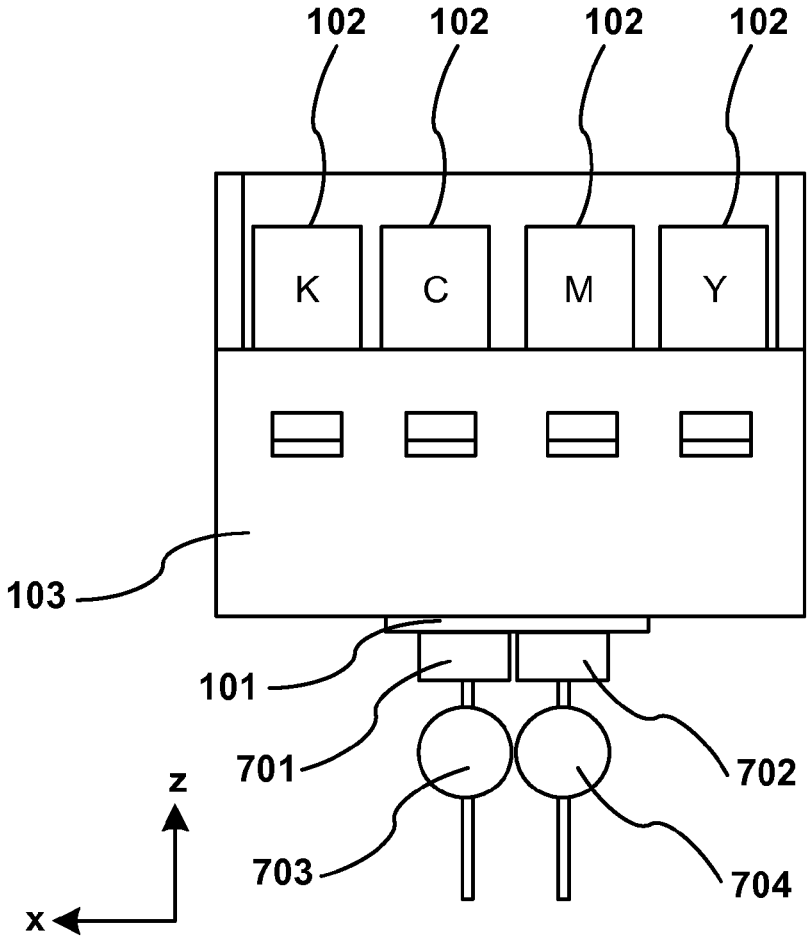
FIG. 7 is a view schematically showing a printhead and a maintenance unit according to the second embodiment.

FIG. 7 is a view schematically showing the arrangement of a printhead and the recovery unit according to the second embodiment.

Note that in FIG. 7, the same components as those already described with reference to FIGS. 2A and 2B have the same reference numerals, and a description thereof will be omitted.

As shown in FIG. 7, a cap A 701 can cap two nozzle arrays for respectively discharging K ink and C ink of the printhead 101, and a cap B 702 caps two nozzle arrays for respectively discharging M ink and Y ink of the printhead 101. The cap A 701 and cap B 702 are connected to a suction pump A 703 and a suction pump B 704, respectively. The suction pump A 703 and suction pump B 704 can perform a suction operation independently of each other.

Figure 8:
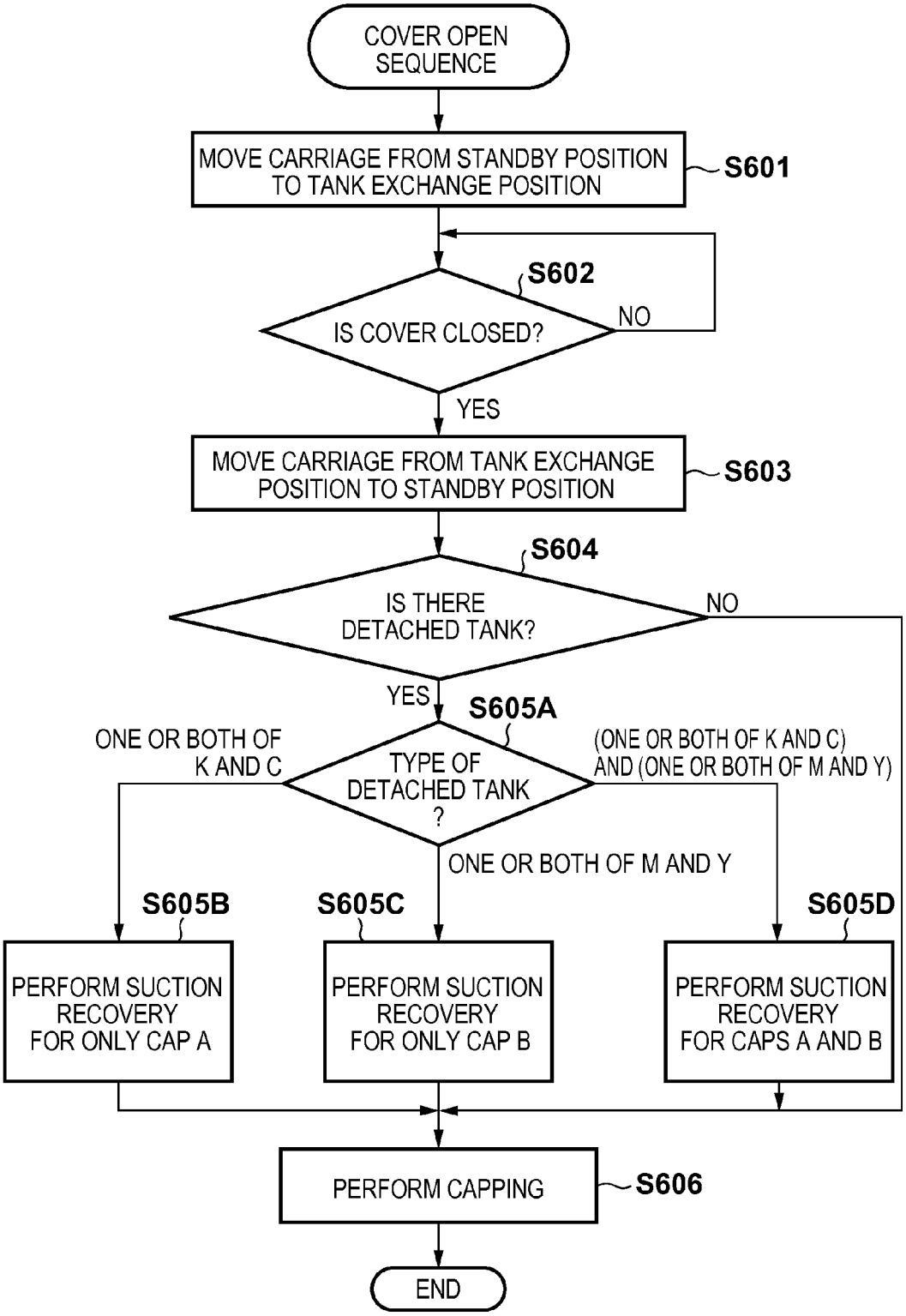
FIG. 8 is a flowchart illustrating suction processing according to the second embodiment.

FIG. 8 is a flowchart illustrating control processing according to the second embodiment.

Note that in FIG. 8, the same processes as those already described in the first embodiment have the same reference symbols, and a description thereof will be omitted.

If it is determined in step S604 that there is a detached ink tank, an ink tank detection sensor is used to check the type of the detached ink tank in step S605A.

If, as a result, the detached ink tank is not the ink tank corresponding to cap B but at least one of the ink tanks containing K ink and that containing C ink corresponding to cap A, the process advances to step S605B. In step S605B, since a filter corresponding to the cap A 701 is exposed to the outer air, a printing apparatus operates only the suction pump A 703, and performs an ink suction operation for nozzles corresponding to the cap A 701 of a printhead 101. Consequently, almost all the ink impregnated in the filter corresponding to the cap A 701 is sucked out. On the other hand, since a filter corresponding to the cap B 702 is attached with the ink tanks, no evaporation of ink impregnated in the filter occurs and the viscosity of ink does not increase.

Alternatively, if the detached ink tank is not the ink tank corresponding to cap A but at least one of the ink tanks containing M ink and that containing Y ink corresponding to cap B, the process advances to step S605C. In step S605C, the apparatus operates only the suction pump B 704 corresponding to the cap B 702, and performs an ink suction operation for nozzles corresponding to the cap B 702 of the printhead 101.

Furthermore, if the detached ink tanks include at least one ink tank corresponding to cap A and at least one ink tank corresponding to cap B, the process advances to step S605D. In step S605D, since the ink tanks respectively corresponding to caps A and B are not attached, the apparatus operates both the suction pump A 703 and suction pump B 704 respectively corresponding to caps A and B, thereby performing a suction operation for the printhead 101.

According to the above-described embodiment, therefore, a suction operation is performed for only a cap corresponding to a detached ink tank, thereby enabling to suck out ink impregnated in a filter without wasting ink more than necessary by suction processing. This suppresses clogging of the filter as in the first embodiment, thereby preventing deterioration in quality of a print image due to a discharge failure.

Third Embodiment

In the first and second embodiments, detection of a detached ink tank is performed when the cover of the printing apparatus is opened/closed, thereby executing a suction operation. In this case, even if the user temporarily closes the cover although he/she intends to attach an ink tank, a suction operation is unwantedly executed. To deal with such a situation, in the third embodiment, a suction operation is executed if there is a detached ink tank when the soft power of a printing apparatus is turned off, instead of at the time of a cover being closed.

A printhead and a recovery unit according to the third embodiment have the same arrangement as that described in the first embodiment.

Figure 9:
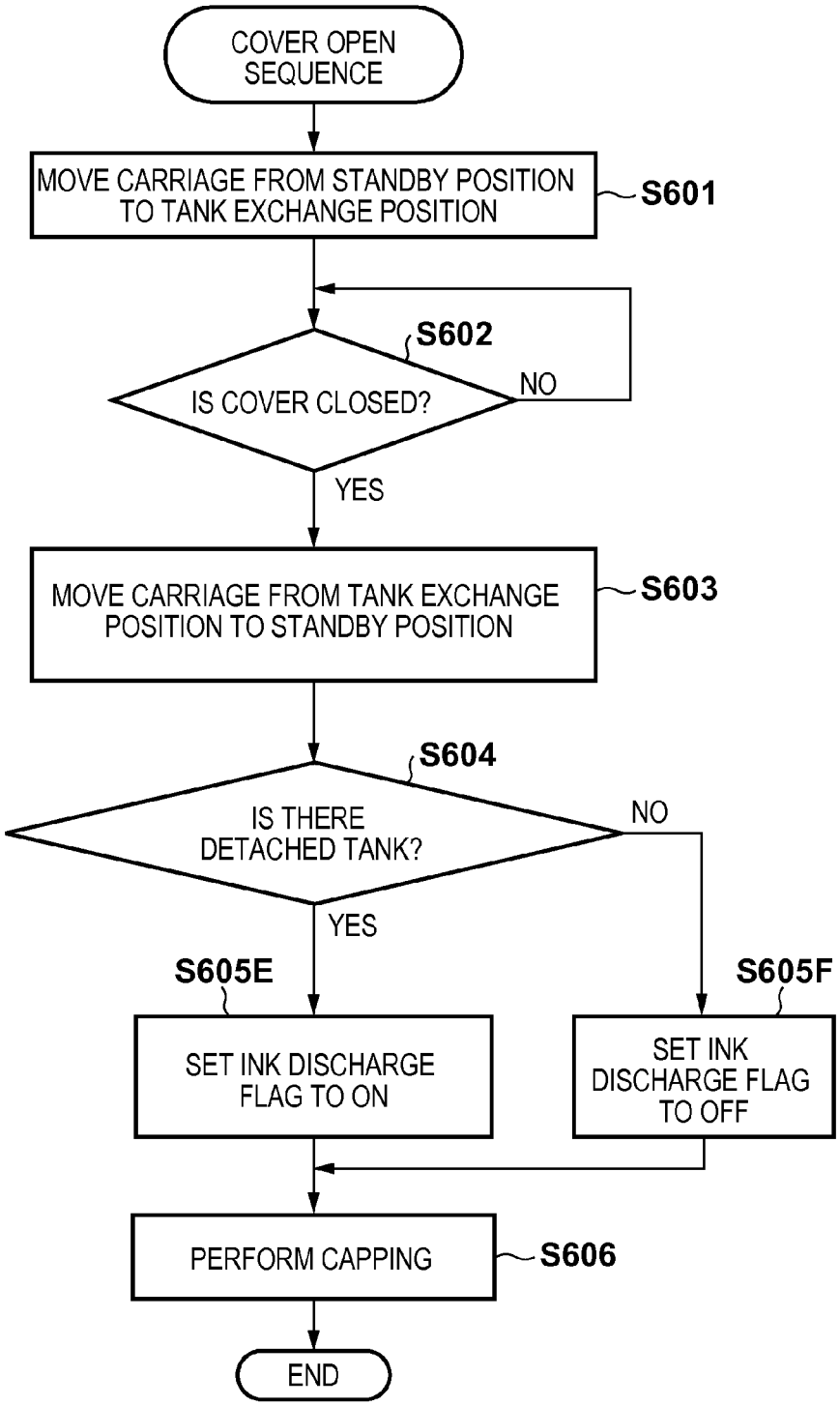
FIG. 9 is a flowchart illustrating suction processing according to the third embodiment.
Figure 10:
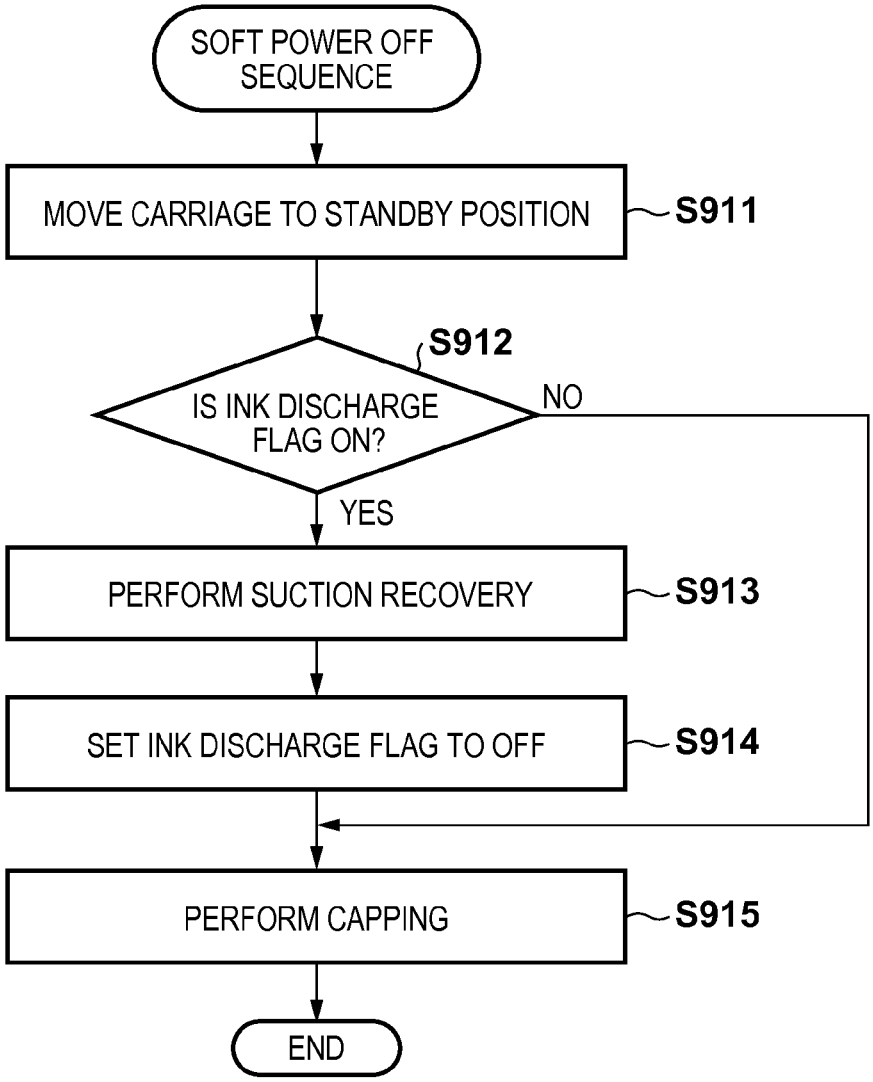
FIG. 10 is a flowchart illustrating suction processing according to the third embodiment.

FIGS. 9 and 10 are flowcharts each illustrating control processing according to the third embodiment.

FIG. 9 is a flowchart illustrating detached ink tank detection processing executed when the cover is manipulated. FIG. 10 is a flowchart illustrating a suction operation executed when the soft power is turned off.

Note that in FIG. 9, the same processes as those already described in the first embodiment have the same reference symbols, and a description thereof will be omitted.

If it is determined in step S604 that there is a detached ink tank, an ink discharge flag set to "ON" is stored in a RAM 302 of the printing apparatus in step S605E, instead of executing a suction operation. On the other hand, if it is determined in step S604 that there is no detached ink tank, an ink discharge flag set to "OFF" is stored in the RAM 302 in step S605F.

If, therefore, the user closes the cover once while an ink tank is detached, and attaches the detached ink tank before the soft power is turned off, it is possible to determine that a filter exposure period to the outer air is short, and suppress execution of a suction operation as an ink discharge operation for the filter.

A suction operation when the soft power is turned off will be described with reference to FIG. 10.

If the user operates the soft power switch of the printing apparatus to turn off the soft power switch, the carriage 103 moves to a standby position in step S911.

In step S912, it is checked whether the ink discharge flag stored in the RAM 302 of the printing apparatus is ON or OFF. If the ink discharge flag is ON, the process advances to step S913; otherwise, the process advances to step S915.

If the ink discharge flag is ON, there is a detached ink tank, and a filter impregnated with ink is exposed to the outer air. If the user turns off the soft power switch in this state, it is highly probable that the printing apparatus will not be used for a long time and the filter will be exposed to the outer air for a long time. In step S913, therefore, the printing apparatus operates a suction pump to execute an ink suction operation for the nozzles of the printhead 101. As in the first and second embodiments, this suction operation results in a significantly small amount of ink remaining in the filter. If, therefore, the remaining ink evaporates and its viscosity increases, clogging of the filter which causes a discharge failure does not occur.

In step S915, capping is performed, thereby terminating the process.

According to the above-described embodiment, in the cover open sequence, even if it is recognized that there is a detached ink tank, a suction operation is not immediately performed while storing the state. If there is a detached ink tank when the soft power switch is turned off, a suction operation is executed. This enables to more effectively suck out ink impregnated in a filter without wasting ink by unnecessary suction processing. As in the first and second embodiments, it is possible to suppress clogging of the filter, thereby preventing deterioration in quality of a print image due to a discharge failure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-106318, filed May 7, 2012, and 2013-080840, filed Apr. 8, 2013, which are hereby incorporated by reference herein in their entirety.

What is claimed is:

1. A printing apparatus comprising:

a printhead having a plurality of nozzles for discharging ink;

an ink tank configured to store ink to be supplied to the printhead and detachably attached to the printhead;

a carriage to which the printhead and the ink tank are mounted;

a detection unit configured to detect whether or not the ink tank is attached to the printhead;

a suction unit configured to perform a suction operation of sucking out ink from the printhead; and a control unit configured to control the suction unit to perform the suction operation if the detection unit detects that the ink tank is not attached to the printhead.

2. The apparatus according to claim 1, further comprising a filter member arranged between the ink tank and the printhead to contact an ink supply port of the ink tank and exposed to outer air when the ink tank is not attached.

3. The apparatus according to claim 2, wherein the filter member is used to prevent a foreign substance from entering the printhead.

4. The apparatus according to claim 2, wherein the filter member is made of metal material.

5. The apparatus according to claim 2, wherein the control unit controls the suction unit to suck out ink impregnated in the filter member.

6. The apparatus according to claim 1, further comprising a cap unit configured to cap a nozzle surface of the printhead, wherein the suction unit sucks out ink from the plurality of nozzles of the printhead by generating negative pressure within the cap unit.

7. The apparatus according to claim 1, wherein the printhead includes a plurality of nozzle arrays, and the carriage includes a plurality of ink tanks respectively corresponding to the plurality of nozzle arrays.

8. The apparatus according to claim 7, wherein the control unit controls the suction unit to perform the suction operation if it is detected that none of the plurality of ink tanks is mounted to the carriage and not to perform the suction operation otherwise.

9. The apparatus according to claim 7, wherein the control unit controls the suction unit to perform the suction operation if it is detected that at least one of the plurality of ink tanks is not mounted to the carriage and not to perform the suction operation if it is detected that all the plurality of ink tanks are mounted to the carriage.

10. The apparatus according to claim 9, wherein the control unit controls the suction unit to perform the suction operation for a nozzle array corresponding to an ink tank, among the plurality of ink tanks, which has been determined not to be mounted to the carriage.

11. The apparatus according to claim 1, further comprising:

a cover of the apparatus; and a cover-state detection unit configured to detect an open/closed state of the cover, wherein the control unit controls to perform the suction operation when the cover-state detection unit detects that the cover is in a closed state.

12. The apparatus according to claim 1, wherein the control unit controls the suction unit to perform the suction operation when an operation of turning off a soft power switch of the printing apparatus is performed.

13. A control method for a printing apparatus including a printhead having a plurality of nozzles for discharging ink, an ink tank for storing ink to be supplied to the printhead and detachably attached to the printhead, and a carriage to which the printhead and the ink tank are mounted, the method comprising:

detecting whether or not the ink tank is attached to the printhead; and performing, if it is detected that the ink tank is not attached to the printhead, a suction operation of sucking out ink from the printhead.

14. The method according to claim 13, wherein the printing apparatus further includes a filter member arranged between the ink tank and the printhead to contact an ink supply port of the ink tank and exposed to outer air when the ink tank is not attached.

15. The method according to claim 13, wherein the printhead includes a plurality of nozzle arrays, and the carriage includes a plurality of ink tanks respectively corresponding to the plurality of nozzle arrays.

16. The method according to claim 15, wherein the suction operation is performed if it is detected that none of the plurality of ink tanks is mounted to the carriage, and the suction operation is not performed otherwise.

17. The method according to claim 15, wherein the suction operation is performed if it is detected that at least one of the plurality of ink tanks is not mounted to the carriage, and the suction operation is not performed if it is detected that all the plurality of ink tanks are mounted to the carriage.

18. The method according to claim 13, wherein the suction operation is performed for a nozzle array corresponding to an ink tank, among a plurality of ink tanks, which has been determined not to be mounted to the carriage.

19. The method according to claim 13, further comprising detecting an open/closed state of a cover of the printing apparatus, wherein the suction operation is performed when it is detected that the cover is in a closed state.

20. The method according to claim 13, wherein the suction operation is performed when an operation of turning off a soft power switch of the printing apparatus is performed.

* * * * *